US006871610B1

(12) United States Patent
Galliano

(10) Patent No.: US 6,871,610 B1
(45) Date of Patent: Mar. 29, 2005

(54) ASSEMBLY FOR LAUNCHING BODIES FROM AN UNDERWATER PLATFORM

(75) Inventor: Carlos E. Galliano, North Kingstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 33 days.

(21) Appl. No.: 10/456,163

(22) Filed: Jun. 6, 2003

(51) Int. Cl.[7] ..... B63B 1/00

(52) U.S. Cl. ..... 114/238; 114/239; 114/312; 114/316; 114/318; 114/320; 89/1.809

(58) Field of Search ..... 114/238, 239, 114/312, 316, 318, 320, 20.1, 20.2, 317, 319, 321; 89/1.809

(56) References Cited

U.S. PATENT DOCUMENTS

| | | | | | |
|---|---|---|---|---|---|
| 249,192 | A | * | 11/1881 | Mallory | 114/20.2 |
| 2,837,971 | A | * | 6/1958 | Wosak | 89/5 |
| 2,848,970 | A | * | 8/1958 | Gunning | 114/319 |
| 3,137,203 | A | * | 6/1964 | Brown | 89/1.81 |
| 3,217,599 | A | * | 11/1965 | Meeker | 89/1.809 |
| 3,581,693 | A | * | 6/1971 | Basset | 114/328 |
| 3,857,321 | A | * | 12/1974 | Cohen | 89/1.81 |
| 3,933,109 | A | * | 1/1976 | Boisrayon et al. | 114/328 |
| 3,969,977 | A | * | 7/1976 | Opdahl et al. | 89/1.81 |
| 4,159,705 | A | * | 7/1979 | Jacoby | 124/63 |
| 4,181,152 | A | * | 1/1980 | Nicoloff | 137/637.1 |
| 4,523,538 | A | * | 6/1985 | Hollmann et al. | 114/238 |
| 5,044,253 | A | * | 9/1991 | Moody | 89/1.81 |
| 5,085,122 | A | * | 2/1992 | Berlam et al. | 89/1.81 |
| 5,099,745 | A | * | 3/1992 | Hubbell et al. | 89/1.81 |
| 5,165,360 | A | * | 11/1992 | Moody | 114/319 |
| 5,170,005 | A | * | 12/1992 | Mabry et al. | 89/1.81 |
| 5,277,144 | A | * | 1/1994 | Moody | 114/319 |
| 5,363,791 | A | * | 11/1994 | Stallard, III | 114/318 |
| 5,375,502 | A | * | 12/1994 | Bitsakis | 89/1.81 |
| 5,568,782 | A | * | 10/1996 | Moody | 114/238 |
| 5,613,460 | A | * | 3/1997 | Stallard, III | 114/312 |
| 5,666,897 | A | * | 9/1997 | Armstrong | 114/20.1 |
| 5,749,312 | A | * | 5/1998 | Hillenbrand et al. | 114/21.2 |
| 5,834,674 | A | * | 11/1998 | Rodriguez et al. | 89/1.81 |
| 5,839,463 | A | * | 11/1998 | Blackmon et al. | 137/1 |
| 6,079,347 | A | * | 6/2000 | Lieb | 114/238 |
| 6,164,179 | A | * | 12/2000 | Buffman | 89/1.81 |
| 6,220,196 | B1 | * | 4/2001 | Escarrat | 114/238 |
| 6,401,645 | B1 | * | 6/2002 | Ansay et al. | 114/238 |
| 6,679,454 | B2 | * | 1/2004 | Olsen et al. | 244/137.1 |
| 6,701,819 | B1 | * | 3/2004 | Williams et al. | 89/1.81 |

* cited by examiner

*Primary Examiner*—Peter M. Poon
*Assistant Examiner*—John Richardson
(74) *Attorney, Agent, or Firm*—James M. Kasischke; Michael F. Oglo; Jean-Peal A. Nasser

(57) ABSTRACT

An assembly for launching bodies from an underwater platform having a pressure hull, and an outer hull subject to free flooding. The assembly includes a module having a proximal end outboard of the pressure hull portion of the platform, a distal end disposed proximate and in alignment with a launch opening in the outer hull portion, and a chamber in the module extending from the distal end of the module to proximate the proximal end of the module, the module chamber being adapted to receive and retain one of the bodies. Support structure on the platform retains the module. A pump on the platform is in communication with water outside the pressure hull, and an impulse tank on the platform is in communication with the pump. A manifold is in communication with the impulse tank for directing outflow of water from the impulse tank to the chamber to eject the body from the chamber.

14 Claims, 1 Drawing Sheet

ASSEMBLY FOR LAUNCHING BODIES FROM AN UNDERWATER PLATFORM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to naval submarine design and construction, and is directed more particularly to a novel assembly for underwater launching of bodies, such as torpedoes, mines, missiles, unmanned underwater vehicles, and the like.

(2) Description of the Prior Art

The horizontal launch of torpedoes and other weapons and devices from submarines has traditionally been conducted with torpedo tubes, typically arranged in groups of two. An impulse tank ports water from an ejection pump to each of the two tubes. Two impulse tank and tube group assemblies are located at the bow of the boat, one assembly on the starboard side and one assembly on the port side.

The aft ends of the tubes are located in a torpedo room and penetrate the forward pressure hull to provide a path to the outboard sea environment. The torpedo room is among the most complex and expensive aspects of submarine design and construction, due in large part to the inherent risk of large pressure hull penetrators, i.e., torpedo tubes of at least twenty-one inches in diameter.

There is a need for a new submarine launch system which does not require large or multiple pressure hull penetrations, in which the bodies to be launched may be stored outside of the pressure hull, and which is, in general, of less cost, weight and complexity than existing systems.

SUMMARY OF THE INVENTION

An object of the invention is, therefore, to provide a launch assembly for submarines, which assembly is devoid of large and multiple pressure hull penetrations, provides for storage outside the pressure hull of bodies to be launched, and which is less expensive than present systems, lighter in weight, and of less complexity.

With the above and other objects in view, as will hereinafter appear, a feature of the present invention is the provision of an assembly for launching bodies from an underwater platform having a pressure hull, and an outer hull subject to free flooding. The assembly includes a module having a proximal end for disposition outboard of the pressure hull portion of the platform, and a distal end for disposition proximate and in alignment with a launch opening in the outer hull portion. A chamber in the module extends from the distal end of the module to proximate the proximal end of the module, the module chamber being adapted to receive and retain one of the bodies. A support structure on the platform retains the module. A pump on the platform is in communication with water outside the pressure hull. An impulse tank on the platform is in communication with the pump. The module is provided with a manifold adapted to be placed in communication with the impulse tank for directing outflow of water from the impulse tank to the chamber to eject the body from the chamber.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts in the two views of the drawings and wherein.

DESCRIPTION OF THE PREFERRED EMBODIMENTS

Figure 1:
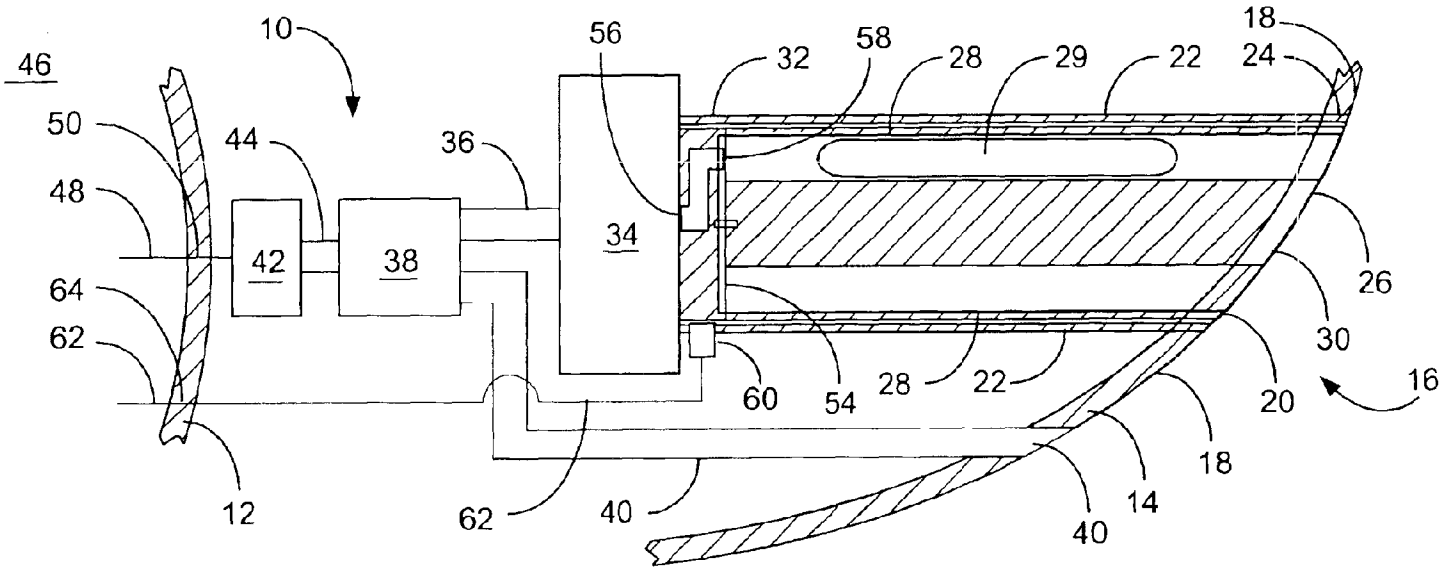
FIG. 1 is a diagrammatic, generally sectional view of one form of assembly illustrative of an embodiment of the invention.

Referring to FIG. 1, it will be seen that the launch assembly 10 is disposed between a pressure hull 12 and an outer hull 14 of a submarine 16. This area is free-flooded when the submarine is submerged.

A bow portion 18 of the outer hull 14 is provided with an opening 20. A support structure, such as a sleeve 22, is disposed at a forward end 24 thereof in the opening 20 and extends aft therefrom. The sleeve 22 is adapted to receive a payload module 26 having therein a selected number of chambers 28, each chamber being adapted to receive and retain a body 29 to be launched.

Figure 2:
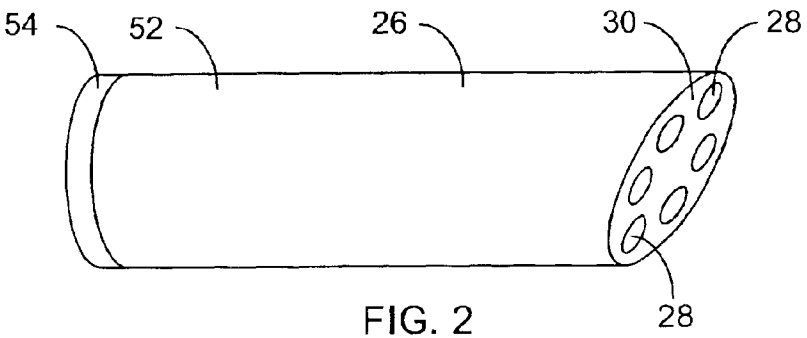
FIG. 2 is a perspective view of a payload module portion of the assembly of FIG. 1.

In FIG. 2, there is shown a payload module 26 having a selected number of chambers 28 therein for torpedoes. Other payload modules (not shown) are configured with appropriate chambers to retain, for example, selected numbers of mines, or missiles, or at least one unmanned underwater vehicle.

The support structure 22 preferably includes not only the sleeve shown in the drawings, but additional support structure as needed to retain the sleeve in position.

Preferably, a forward end 30 of the payload module 26 is conformed to the configuration of the outer hull 14.

At an aft end 32 of the support structure sleeve 22, there is disposed an impulse tank 34 which is in communication by way of a conduit 36, with a pump 38. The pump 38 receives sea water through conduit 40, pressurizes the sea water and forces the pressurized sea water through the conduit 36 to the impulse tank 34.

The pump 38 is in driving communication with an electric motor 42, as by a drive shaft 44. The electric motor 42 is in electrical communication with an interior portion 46 within the pressure hull 12, as by a cable 48 extending through a pressure hull penetration 50.

Each module 26 is provided at its aft end 52 with a manifold 54 having an inlet 56 in communication with the impulse tank 34 and an outlet 58 which is movable by rotational movement of the manifold 54 to align with a selected one of the chambers 28.

A manifold controller 60 serves to detect the current position of the manifold 54 and move the manifold in accordance with instructions received from the submarine interior portion 46 by way of a cable 62 which extends through a pressure hull penetration 64.

In operation, instructions as to which chamber 28 is to be fired are sent from the interior portion 46 of the submarine 16 through the cable 62 to the controller 60 which detects where the manifold outlet 58 is disposed and, if warranted, moves the manifold 54 rotatably until the outlet 58 is in alignment with the appropriate chamber 28. By signal through the cable 48, the electric motor 42 drives the pump 38 which pressurizes water received from the conduit 40 and forces the water into the impulse tank 34 and thence through the manifold 54 and into the appropriate chamber 28 to launch body 29, such as a torpedo.

There is thus provided a novel launch system for submarines which includes only two very small pressure hull penetrations, in which the launch bodies are stored outside the pressure hull, to render space available within the pressure hull, and which is of less cost, weight and complexity than traditional torpedo rooms and attendant systems.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. An assembly for launching bodies from an underwater platform having a pressure hull and an outer hull having a free flood region defined therebetween, the assembly comprising:

a module having a proximal end for disposition outboard of the pressure hull portion of the platform, a distal end for disposition proximate and in alignment with a launch opening in the outer hull portion, and a chamber defined in said module extending from the distal end of said module to proximate the proximal end of said module, said module chamber being adapted to receive and retain one of the bodies, said module being fully located outside the pressure hull of the platform;

support structure on the platform capable of receiving and retaining said module;

a pump on the platform capable of pumping water;

an impulse tank on the platform and in communication with said pump; and a manifold in communication with said impulse tank for directing outflow of water from said impulse tank to the chamber of said module to eject the body from the chamber.

2. The assembly in accordance with claim 1 wherein said module is provided with at least one additional chamber for receiving and retaining an additional body.

3. The assembly in accordance with claim 1 wherein said module is provided with additional chambers, each for receiving and retaining an additional body.

4. The assembly in accordance with claim 1 wherein the module distal end is configured so as to conform to a configuration of the outer hull portion.

5. The assembly in accordance with claim 1 wherein said module is of a circular cross-section and said support structure comprises a sleeve for receiving and retaining said module.

6. The assembly in accordance with claim 5 wherein said support structure is disposed between the pressure hull and the outer hull.

7. The assembly in accordance with claim 6 wherein said pump and said impulse tank are disposed between the pressure hull and the outer hull.

8. The assembly in accordance with claim 2 wherein said manifold is mounted on the proximal end of said module and is provided with an inlet for receiving pressurized water from said impulse tank, the inlet being in communication with a manifold outlet which is movable to align with a selected one of the chambers.

9. The assembly in accordance with claim 8 wherein said manifold is rotatably mounted on said module such that rotative movement of said manifold moves the manifold outlet in a circular fashion.

10. An assembly for launching bodies from an underwater platform having a pressure hull and an outer hull having a free flood region defined therebetween, the assembly comprising:

a module having a proximal end for disposition outboard of the pressure hull portion of the platform, a distal end for disposition proximate and in alignment with a launch opening in the outer hull portion, and at least two chambers defined in said module extending from the distal end of said module to proximate the proximal end of said module, said module chamber being adapted to receive and retain one of the bodies;

support structure on the platform capable of receiveing and retaining said module;

a pump on the platform;

an impulse tank on the platform and in communication with said pump; and a manifold in communication with said impulse tank for directing outflow of water from said impulse tank to the chamber of said module to eject the body from the chamber wherein said manifold is mounted on the proximal end of said module and is provided with an inlet for receiving pressurized water from said impulse tank, the inlet being in communication with a manifold outlet which is movable to align with a selected one of the chambers; and a manifold controller joined to said manifold for sensing a current position of said manifold and effecting rotation of said manifold in response to a signal from an interior portion of the platform to place the manifold outlet in alignment with the selected one of the chambers.

11. The assembly in accordance with claim 1 wherein the assembly further comprises a motor joined to said pump.

12. The assembly in accordance with claim 7 wherein the assembly further comprises a motor disposed between the pressure hull and the outer hull and drivingly connected to said pump.

13. The assembly in accordance with claim 1 wherein the pump is capable of being in communication with water at environmental pressure.

14. The assembly in accordance with claim 13 wherein the water at environmental pressure is water located in the free flood region between the pressure hull and the outer hull.

* * * * *